US005744694A

United States Patent [19]

Bertéet al.

[11] Patent Number: 5,744,694

[45] Date of Patent: Apr. 28, 1998

[54] GELLED COMPOSITIONS CONTAINING ORGANIC LIQUIDS

[75] Inventors: Ferruccio Berté; Gianmarco Polotti, both of Bergamo, Italy

[73] Assignee: 3V Inc., Weehawken, N.J.

[21] Appl. No.: 819,831

[22] Filed: Mar. 18, 1997

[30] Foreign Application Priority Data

Feb. 7, 1997 [IT] Italy ..... MI97A0249

[51] Int. Cl.[6] ..... C10L 7/02; C10L 7/04

[52] U.S. Cl. ..... 44/266; 44/271; 424/401; 424/78.02; 514/944

[58] Field of Search ..... 44/265, 266, 268, 44/271, 272; 424/78.02, 401; 514/944

[56] References Cited

U.S. PATENT DOCUMENTS 3,148,958 9/1964 Movick ..... 44/266

3,461,006 8/1969 Fay et al. ..... 44/266

4,146,368 3/1979 Troffkin et al. ..... 44/265

5,496,891 3/1996 Stead et al. ..... 525/330.2

5,641,890 6/1997 Wesley et al. ..... 44/271

*Primary Examiner*—Jacqueline V. Howard

*Attorney, Agent, or Firm*—Griffin, Butler Whisenhunt & Szipl

[57] ABSTRACT

Thickened or gelled compositions comprising an organic liquid, a crosslinked copolymer of an acrylic acid, a vinyl ester of trialkylacetic acids with highly branched structure containing up to 10 carbon atoms, a neutralizing base and, optionally, water are disclosed together with a method for their preparation. These compositions have high stability and are viscoelastic and can be used, for example, in cosmetics, detergents, or as fuels for domestic use or for transportable stoves.

18 Claims, No Drawings

GELLED COMPOSITIONS CONTAINING ORGANIC LIQUIDS

The present invention relates to thickened or gelled compositions comprising 1) an organic liquid, 2) a crosslinked copolymer of a) one or more olefinically unsaturated carboxylic acids, b) one or more vinyl esters of trialkylacetic acids with highly branched structure of formula I

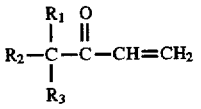

(I)

wherein $R_1$, $R_2$ and $R_3$, which can be the same or different, are linear alkyl residues, at least one of which is always methyl, and wherein the sum of the carbon atoms of the acyl residue may reach ten, c) one or more polyunsaturated monomers as crosslinking agents, and 3) an organic or inorganic base, in an amount sufficient to partially or totally neutralize the acidity deriving from the copolymer, wherein said compositions may also comprise water.

The reasons for which, in certain cases, it is preferable to use a thickened or gelled organic liquid are well-known to the expert in the art. For example, in case of vertical surfaces to which one wishes to apply an organic liquid, it is undoubtedly disadvantageous to apply said liquid as such, especially if it has low viscosity. For the same reasons, those organic liquids, which are the components of organic based paints or rust removers and, also, the components of many cosmetic compositions such as shampoos, creams, lotions, ointments, nail lacquers solvents, etc. are more conveniently used in thickened or gelled form. Moreover, the incorporation of volatile organic liquids in thickened or gelled compositions allows to reduce their diffusion in the environment, to the interest of the persons handling them.

That of fuels for domestic use or for transportable stoves is a field wherein the use of thickened or gelled organic liquids is widespread, wherein the organic liquids are highly flammable, volatile substances, for example methanol, ethanol, isopropanol, ethyl ether, or aromatic compounds such as benzene, toluene, xylenes, and analogs. In this way, once they are put in a suitable container, they become steady heat sources, for example for chafing dishes, or, they can be used to sprinkle firewood or charcoal, also while they are burning, thus avoiding, or considerably reducing the risk of burns for the user.

The patent literature reports many examples of thickened or gelled compositions containing organic liquids, in which one of the components is a polymer or a copolymer of acrylic or methacrylic acid. See, for instance, GB 1,251,002, which describes compositions of particular organic liquids, water and CARBOPOL™ 934, or U.S. Pat. No. 3,759,674, disclosing dispersions of certain ethylene-acrylic acid copolymers and aminic emulsifiers in water to give gelled stable compositions when mixed with alcohols. In Japanese Patent Application JP 63 70797, gelled compositions consisting of mixtures of methanol, isopropanol and polyacrylic acid are still described, whereas Brazilian Patent 90 02455 claims compositions wherein ethanol is the organic liquid and a polyallylsaccharose-acrylic acid copolymer is the copolymer. Finally, European Patent Application EP 580 246 discloses compositions in which the polymer essentially belongs to the CARBOPOL™ family, which, in addition, contain amphoteric oxides and/or fatty acids and/or salts of fatty acids with the purpose of improving the rheological properties and thixotropicity of the compositions, and in which the organic liquid is essentially an alcohol.

To be advantageously used, the compositions, particularly the compositions where the organic liquid is a fuel, must also have an acceptable stability toward the sudden changes of temperature, in order not to freeze or to avoid the separation of the organic liquid as such from the composition, thus making difficult both its storage and transport. Said compositions must also have a remarkable viscoelastic index, so as to contain the possible spill from an overturned container, as well as posses good and lasting comburent capacity. The known and actually used compositions not always display one or more of these characteristics in a satisfactory manner. Therefore, it is still felt the need of more effective compositions.

As said above, the present invention relates to thickened or gelled compositions, comprising 1) an organic liquid, 2) a crosslinked copolymer of a) one or more olefinically unsaturated carboxylic acids, b) one or more vinyl esters of trialkylacetic acids with highly branched structure of formula (I)

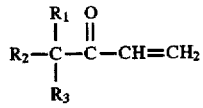

(I)

wherein $R_1$, $R_2$ and $R_3$ are linear alkyl residues, at least one of which is always methyl, and wherein the sum of the atoms of the acyl residue may reach ten, c) one or more polyunsaturated monomers as crosslinking agents, and 3) an organic or inorganic base, in an amount sufficient to partially or totally neutralize the acidity deriviing from the copolymer, wherein said compositions may also comprise water.

More particularly, in the compositions of the present invention, the organic liquids 1) can be of any kind. Therefore, they can be hydrocarbons, alcohols, glycols, ethers, aldehydes, ketones, esters, amides, amines, nitro compounds, phenols, terpenes, terpenoids, essential oils, sulfur compounds etc., whether of aliphatic, aromatic, arylaliphatic, heterocyclic or heteroaliphatic nature. Representative examples of these liquids are aliphatic hydrocarbons of from 5 to about 16 carbon atoms; aromatic hydrocarbons such as benzene, toluene and xylenes; aliphatic alcohols of from 1 to 8 carbon atoms; benzyl alcohols bearing different substituents; ethylene and propylene glycols and their corresponding mono-, di- or trialkyl ethers; aliphatic ethers of from 2 to 8 carbon atoms; phenol ethers; aliphatic or arylaliphatic aldehydes of from two to about 12 carbon atoms; benzaldehyde; substituted benzaldehydes such as, for example, orto- and meta-nitrobenzaldehyde; aliphatic ketones of from 3 to about 8 carbon atoms; diacetone alcohol; aliphatic or arylaliphatic esters of mono- or dicarboxylic acids of from 2 to about 10 carbon atoms; alkyl esters of optionally substituted benzoic acid such as, for example, methyl salicylate; dimethylformamide; dimethylacetamide; aniline; nitromethane; nitrobenzene; nitrotoluene; anisole; eugenol; geraniol; farnesol; d-verbenone; ethanedithiol; dimethylsulfoxide; nitriles; picoline; furan, tetrahydrofuran, tetrahydropyran; and analogs.

With the expression "organic liquid" it is meant a single organic liquid, or a mixture of two or more organic liquids in the most different weight ratios. For the scopes of the invention, they can be used as such, or also in the form of the corresponding possible mixtures with water.

In the crosslinked copolymers 2), the olefinically unsaturated acids which can be used are, for example, acrylic acid and methacrylic acid, whereas the vinyl esters of formula (I) are, for example, those of the versatic acids. They are commercial products, such as those marketed under the trade name of VeoVa™ (Trade mark of Shell Chemicals). Finally, the polyunsaturated monomers c) acting as crosslinking agents are, for example, polyallyl ethers of monosaccharides or disaccharides, di-, tri- or tetraallyl ethers of pentaerythritol or trimethylolpropane, divinyl glycol, polyethylene glycol diallyl ether, allyl acrylate or methacrylate, diallyl adipate or triallyl cyanurate. The crosslinked copolymers 2) are commercial products (STABILEN 30 (R), ACRISINT 330 (R), 3V SIGMA S.p.A., Bergamo, Italia). In any case, they can be prepared according to the procedure described in Belgian Patent 903 354, or as shown in the examples reported below. In these copolymers, the vinyl esters of formula (I) can be used in amounts ranging from about 0.3 to about 30% by weight with respect to the total weight of the monomers, whereas the polyunsaturated crosslinking monomers can be used in amounts ranging from about 0.1 to about 5% by weight, always with reference to the total weight of the monomers. With the term "crosslinked copolymer" it is meant both the single crosslinked copolymers 2), and their mixtures in the most different weight ratios. For the scopes of the invention, their corresponding mixtures with water or organic solvents can also be used.

The neutralizing base 3) can be an alkali or alkaline earth metal hydroxide, or a primary, secondary or tertiary, saturated or unsaturated, aliphatic amine, in which the aliphatic residues can also be substituted with free OH groups, and in which the total content of carbon atoms of the aliphatic residues can vary from 1 to about 40, or a polyoxyethylene amine such as, for example, polyethylene glycol derivatives of Cocamine. Examples of these amines are methyl amine, ter-butyl amine, dipropyl amine, triethyl amine, diisopropanol amine, triethanol amine, ETHOMEEN™ C-25 and analogs. If an amine with a high content of carbon atoms is used, it can be convenient to work in the presence of a low molecular weight alkanol.

With the term "base" it is intended a single base, organic or inorganic, or a mixture of two or more bases in the most different weight ratios. For the scopes of the invention, the bases can be used as such or also in the form of the corresponding aqueous or organic solutions.

Finally, when it is desired that the composition contains water, the latter can derive from the corresponding mixtures of the compounds 1) and/or 2) and/or 3), or can separately be added to the composition.

In the compositions of the present invention, the organic liquid 1) or the mixture of organic liquids can represent up to 90%, the crosslinked copolymer 2) or the mixture of crosslinked copolymers can be present in amounts from about 0.01 to about 5%, whereas the base 3) or the mixture of bases can represent from about 0.01 to about 20%. These percent values, as well as those reported below, are meant to be calculated on the weight of the final composition.

In a preferred aspect of the present invention, the organic liquid 1) is a highly flammable and volatile substance such as, for example, an aliphatic hydrocarbon of from 5 to 16 carbon atoms, methanol, ethanol, propanol, isopropanol, ethyl ether, benzene, toluene, a xylene, nitromethane, nitrobenzene and analogs, or a mixture of two or more of these, or a corresponding possible mixture with water. More preferably, the organic liquid is methanol, ethanol, propanol or isopropanol, a mixture thereof, or a corresponding mixture with water. The organic liquid as such is present in the compositions of the invention in amounts preferably ranging from about 40 to about 90%.

The crosslinked copolymer 2) is preferably present in amounts ranging from about 0.05 to about 3% of the weight of the composition. Preferably, it is a crosslinked copolymer as defined above, in which the component a) is acrylic acid, the component b) is a vinyl ester of the versatic acid 10 marketed as VeoVa™ 10 (trade mark of Shell Chemicals), used in amounts of from about 0.4 to about 8% by weight of the total weight of the monomers used, and the component c) is a di-, tri-, or tetraallyl ether of pentaerythritol, used in amounts of from about 0.4 to about 1.5% of the total weight of the monomers used. The crosslinked copolymer 2), or a mixture thereof is, preferably, used as such.

Finally, the neutralizing base 3) is, preferably, a primary, secondary or tertiary, saturated or unsaturated, aliphatic amine, in which the aliphatic residues can also be substituted with free OH groups, and in which the total content of carbon atoms of the aliphatic residues can vary from 1 to about 40, or a polyethylene glycol derivative of Cocamine, and is present as such in the composition in amounts ranging from about 0.05 to about 10%. More preferably, the base is a secondary or tertiary aliphatic amine in which the total content of carbon atoms of the aliphatic residues, optionally substituted with one or more free OH groups, ranges from 4 to 10, or a polyethylene glycol derivative of Cocamine, and is used as such or as an aqueous solution.

The crosslinked copolymers 2) are well-known to be thickening agents. However, their use in the preparation of thickened or gelled compositions such as, for example, those of the present invention is new. Therefore, a further object of the present invention is the use of these copolymers as thickening or gelling agents of organic liquids, preferably of flammable organic liquids.

The thickened or gelled compositions of the present invention are prepared admixing, in the above weight ratios, the organic liquid 1), the crosslinked copolymer 2) and the base 3). Whenever water is desired to be present in the final compositions and it does not already derive, or does not derive in sufficient amount from one or more of the aqueous mixtures of the components 1), 2) or 3), then water may optionally be added to the composition. The order of addition of the components is not critical. However, it is preferred to prepare first a mixture, as homogeneous as possible of the crosslinked copolymer in the organic liquid and subsequently add the base. Stirring is suitable, also because of the continuous increase of viscosity, especially during the neutralization phase. The water, if necessary, can be added at any moment of the preparation of the composition.

The thickened or gelled compositions object of the present invention have shown to possess excellent properties. One of said properties is represented by their high viscosity, such that the compositions of the invention can be classified as solids, according to the standards provided by ASTM D 4359-84. They proved to be very stable in the time, poorly sensitive to the sudden changes of temperature, and keep their state also after vigorous shaking, differently from other gelled compositions, which become liquid. Finally, in case of compositions in which the organic liquid is a highly flammable substance, they have also demonstrated to possess very good comburent properties.

Colloidal thickening agents or long chain fatty acids or their salts, or mixtures of these colloidal thickening agents and long chain fatty acids, as such or in the form of their salts, can optionally be added to the thickened or gelled compositions of the present invention with the purpose of improving, as the case may be, the rheological properties of said compositions. Examples of such colloidal thickening agents are dispersions of micronized amphoteric metal oxides such as, for example, those marketed under the trade names of Dispal Alumina 23 N4-80, Dispal Alumina 23

N4-20 etc. by the Vista Chemical Company of Houston, Tex., U.S.A., or colloidal dispersion forming clays such as, for example, those of the smectites or kaolin families, or illites, attapulgites, and analogs: they are well-known products in the literature, in any case easily available on the market. Examples of long chain organic acids are, preferably, linear or branched, saturated or unsaturated aliphatic acids of from about 10 to about 20 carbon atoms. If said acids are used in the form of salts, these latter are preferably salts of alkaline-earth or transition metals. The thickening colloidal agents of fatty acids, as such or in the form of their salts, shall be used in the amounts which the expert in the art will recognize as more suitable to obtain compositions which satisfy the scopes of the present invention.

The thickened or gelled compositions of the present invention can be applied in the more different industrial fields, according to the organic liquid contained therein. As already stated above, when the organic liquid is a highly flammable and volatile liquid, these compositions are used as "solid fuels" for domestic uses or to form the base fuel of transportable stoves. In this sense, since some of these organic liquids burn with colourless flame, these compositions can also contain particular metals which make it visible, so as to reduce the risks for the user. However, the compositions of the present invention can also form the base for cosmetic formulations (gels, perfumes, deodorants, after shave, make-up removers, shampoos, nail lacquers remover), for detergents, for organic-based paints, for products to be used in the textile industry. They can be incorporated in containers of different forms such as, for example, pots, jars, tubes, spray cans, manufactured with the usual materials available on the market.

The following examples have the purpose of further illustrating the above described invention.

EXAMPLES 1–6

The following examples disclose the preparation of some crosslinked copolymers 2) which can be used in the compositions of the invention. A general procedure, and the amounts of the several monomers a), b) and c) used from time to time is provided, as well as the amounts of copolymer obtained are reported in Table 1 below.

Procedure

Acrylic acid, VeoVa™ 10, pentaerythritol triallyl ether and bis-(ter-butylcyclohexyl)-peroxydicarbonate are dissolved in 1600 ml of methylene chloride. The resulting solution is refluxed for 11 hours. Subsequently, the solvent is removed in vacuo, thus obtaining a product in the form of a white powder. The conversion is complete, and in this manner 100 g of crosslinked copolymer are obtained.

TABLE 1

| Example | Acrylic acid (g) | VeoVa™ 10 (g) | Pentaerythritol triallyl ether (g) |
|---|---|---|---|
| 1 | 96.40 | 2.00 | 1.10 |
| 2 | 96.30 | 2.00 | 1.20 |
| 3 | 91.40 | 7.00 | 1.10 |
| 4 | 93.20 | 6.10 | 0.20 |
| 5 | 97.70 | 1.00 | 0.80 |
| 6 | 98.40 | 0.50 | 0.60 |

The following examples illustrate the preparation of some compositions representative of the present invention.

EXAMPLE 7

Preparation of a composition weighing 300 grams 229.3 g of 95% ethanol are placed in a 500 g beaker. Under strong stirring, 1.5 g of copolymer are dispersed. Stirring is continued for about 30 minutes or anyway, up to the complete dissolution of all the copolymer lumps. Under a gentler stirring, 66.5 g of water are added. Finally, the acidity of the polymer is neutralized very slowly with 2.7 g of 85% diisopropanolamine. The product is left to stand for about 24 hours and, subsequently, the viscosity is determined (Brookfield viscosimeter RVT, spindler 7, T 25° C). The viscosities are expressed in Pa.s (Pascal sec.). The following values are obtained (rpm: rounds per minute).

| Copolymer | 5 rpm | 20 rpm | 100 rpm |
|---|---|---|---|
| Ex. 1 | 152 | 40.8 | 12.6 |
| Ex. 2 | 108 | 35 | 10.6 |

EXAMPLE 8

Preparation of a composition weighing 300 grams 229.3 g of methanol are placed in a 500 g beaker. Under strong stirring, 1.5 g of copolymer are dispersed. Stirring is continued for about 30 minutes or, anyway, up to the complete dissolution of all the copolymer lumps. Under a gentler stirring, 66.5 g of water are added. Finally, the acidity of the polymer is neutralized very slowly with 2.7 g of 85% diisopropanolamine. The product is left to stand for about 24 hours and, subsequently, the viscosity is determined as in Example 7. The following values are obtained.

| Copolymer | 5 rpm | 20 rpm | 100 rpm |
|---|---|---|---|
| Ex. 1 | 108 | 35 | 10 |
| Ex. 2 | 113.6 | 36.4 | 10.2 |

EXAMPLE 9

Preparation of a composition weighing 300 grams 229.3 g of isopropyl alcohol are placed in a 500 g beaker. Under strong stirring, 1.5 g of copolymer are dispersed. Stirring is continued for about 30 minutes or anyway up to the complete dissolution of all the copolymer lumps. In a separate beaker a 20% ETHOMEEN™ C-25 solution is prepared. The acidity of the polymer is neutralized very slowly with 69.2 g of the base solution prepared separately. The product is left to stand for about 24 hours and, subsequently, the viscosity is determined as in Example 7. The following values are obtained.

| Copolymer | 5 rpm | 20 rpm | 100 rpm |
|---|---|---|---|
| Ex. 1 | 48.2 | 16 | 4.91 |
| Ex. 2 | 52.6 | 17.2 | 5.25 |

EXAMPLE 10

Preparation of a composition weighing 300 grams 229.3 g of isopropyl alcohol are placed in a 500 g beaker. Under strong stirring, 1.5 g of copolymer are dispersed.

Stirring is continued for about 30 minutes or, anyway, up to the complete dissolution of all the copolymer lumps. In a separate beaker a 20% ETHOMEEN™ C-25 solution is prepared. The acidity of the polymer is neutralized very slowly with 69.2 g of the base solution previously prepared. Finally, 3 g of bentonite for organic solvents (Fluka) are added, stirring for about 60 minutes. The product is left to stand for about 24 hours and the determination of the viscosity is made as reported in Example 7. The following values are obtained.

| Copolymer | 5 rpm | 20 rpm | 100 rpm |
|---|---|---|---|
| Ex. 1 | 50.2 | 17 | 5.11 |
| Ex. 2 | 56.1 | 18.4 | 6 |

What is claimed is:

1. A thickened or gelled composition comprising 1) an organic liquid, 2) a crosslinked polymer of a) one or more olefinically unsaturated carboxylic acids, b) one or more vinyl esters of trialkylacetic acids with highly branched structure of formula (I)

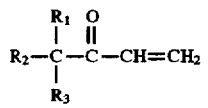

(I)

wherein $R_1$, $R_2$ and $R_3$, which can be the same or different, are linear alkyl residues, at least one of which is always methyl, and wherein the sum of the carbon atoms of the acyl residue may reach ten, c) one or more polyunsaturated monomers as crosslinking agents, and 3) an organic or inorganic base, in an amount sufficient to partially or totally neutralize the acidity deriving from the copolymer, wherein said compositions may also comprise water.

2. A composition according to claim 1, in which the organic liquid can represent up to 90%, the crosslinked copolymer is present in amounts from about 0.01 to about 5%, and the base represents from about 0.1 to about 20%, said values being calculated on the weight of the composition.

3. A composition according to claim 1, in which the organic liquid can represent from about 40 to about 90%, the crosslinked copolymer is present in amounts from about 0.05 to about 3%, and the base represents from about 0.5 to about 10%, said values being calculated on the weight of the composition.

4. A composition according to claim 1, in which the organic liquid is a single organic liquid or a mixture of organic liquids, the copolymer is a single copolymer or a mixture of copolymers, and the base is a single base or a mixture of bases.

5. A composition according to claim 1, in which the organic liquid is a flammable liquid.

6. A composition according to claim 5, in which the flammable liquid is selected from the group consisting of an aliphatic hydrocarbon of from 5 to 16 carbon atoms, methanol, ethanol, propanol, isopropanol, ethyl ether, benzene, toluene, a xylene, nitromethane, nitrobenzene and mixtures thereof.

7. A composition according to claim 6, in which the flammable liquid is selected from the group consisting of methanol, ethanol, propanol, isopropanol and mixtures thereof.

8. A composition according to claim 1, in which, in the crosslinked copolymer, the component a) is acrylic acid, the component b) is a vinyl ester of the versatic acid 10, and the component c) is selected from the group consisting of a di-, tri- or tetraallyl ether of pentaerythritol.

9. A composition according to claim 1, in which the base is an alkali or alkaline earth metal hydroxide, or a primary, secondary or tertiary, saturated or unsaturated aliphatic amine, in which the aliphatic residues can be substituted with free OH groups, and in which the total content of carbon atoms of the aliphatic residues can vary from 1 to about 40, or a polyoxyethylene amine.

10. A composition according to claim 9, in which the base is a primary, secondary or tertiary, saturated or unsaturated aliphatic amine, in which the aliphatic residues can be substituted with free OH Groups, and in which the total content of carbon atoms of the aliphatic residues can vary from 1 to about 40, or a polyethylene glycol-derivative of Cocamine.

11. A composition according to claim 10, in which the base is a secondary or tertiary saturated aliphatic amine in which the total content of the carbon atoms of the aliphatic residues, optionally substituted with one or more free OH groups, ranges from 4 to 10, or a polyethylene glycol-derivative of Cocamine.

12. A composition according to claim 11, in which the base is diisopropanol amine or a polyethylene glycol-derivative of Cocamine.

13. A method for preparing a thickened or gelled composition as defined in claim 1, comprising the addition of the crosslinked copolymer 2) to the organic liquid 1), and the subsequent addition to the thus obtained mixture of the base 3), in order to partially or totally neutralize the acidity deriving from the copolymer.

14. A method according to claim 13, comprising also the addition of water.

15. A method according to claim 13, in which one or both of the organic liquids and the base are used as mixtures with water.

16. A method for preparing thickened or gelled organic liquids, comprising the addition of the crosslinked copolymer 2) as defined in claim 1 to said organic liquid.

17. A method for preparing thickened or gelled organic flammable liquids, comprising the addition of the crosslinked copolymer 2) as defined in claim 1 to said organic flammable liquid.

18. A container containing a thickened or gelled composition as defined in claim 1.

* * * * *